United States Patent [19]

Chopra et al.

[11] 4,036,138

[45] July 19, 1977

[54] RIGID WATERPROOF CONTAINER FOR SLURRIED EXPLOSIVES IN SMALL DIAMETERS

[75] Inventors: Gopal Mohan Chopra; Tyagaraja Gangadharan; Ram Narain Sinha, all of Bihar, India

[73] Assignee: Indian Explosives Limited, India

[21] Appl. No.: 641,456

[22] Filed: Dec. 17, 1975

[51] Int. Cl.[2] ..... F42B 3/00

[52] U.S. Cl. ..... 102/24 R; 206/497; 229/3.1; 229/4.5; 229/48 T; 53/184 S

[58] Field of Search ..... 102/24; 53/184 S; 206/497; 229/3.1, 4.5, 48 T

[56] References Cited

U.S. PATENT DOCUMENTS

| | | | |
|---|---|---|---|
| 2,408,189 | 9/1946 | Baker | 102/24 |
| 3,200,743 | 8/1965 | Griffith et al. | 102/24 |
| 3,321,886 | 5/1967 | Griffith et al. | 53/184 S |
| 3,402,874 | 9/1968 | Sternan | 206/497 |
| 3,731,625 | 5/1973 | Slawinski | 102/24 |
| 3,837,279 | 9/1974 | Cooke, Jr. | 102/24 |

*Primary Examiner*—Verlin R. Pendegrass
*Attorney, Agent, or Firm*—Ladas, Parry, Von Gehr, Goldsmith & Deschamps

[57] ABSTRACT

The present invention relates to a waterproof and rigid container for slurried explosives which comprises a tube or shell formed by superimposing partially or wholly a shrinkable film on paper and rolling the film and paper into the shape of a tube or shell of continuous and successive layers of the film and paper, the inner layer being the film and the outer layer being the paper, and thereafter crimping the tube or shell to one end, the tube or shell so formed being externally coated with a suitable waterproofing medium under predetermined conditions thereby causing a partial shrinkage of the film and, when required, the waterproofed tube or shell is filled with an explosive and the filling or mouth end is crimped and waterproofed forming a rigid and waterproof cartridge.

8 Claims, 9 Drawing Figures

RIGID WATERPROOF CONTAINER FOR SLURRIED EXPLOSIVES IN SMALL DIAMETERS

This invention relates to rigid waterproof containers and a process for making them. More particularly, such rigid waterproof containers are used for packing small diameter slurried explosives.

The current practice is to cartridge slurried explosives in polythene tubing or a film which is formed into a tube and heatsealed. To obtain small unit packs, the tubing is squeezed and clipped at required lengths to obtain individual "sausages" or "cartridges". Since polythene is stretchable and also permeable to air, the cartridges tend to become limp, even though they may have been tightly filled and rigid after manufacture.

To overcome these deficiencies, a laminate of polythene, polyester film and polythene has been used. However, a certain increase in the density of the explosive is inevitable on storage, and this again causes limpness of cartridges, in spite of overcoming stretchability and air permeability by the use of polyester film.

Further, with such a system, each length of tubing has to be individually filled and clipped thereby limiting the rate of production. It also requires a special clipping device for closing the ends of the cartridges. Heat sealing of ends is rendered imperfect by a film of the contents remaining between the layers of polythene being sealed. Also, the temperature required for sealing is unsafe for working with explosives.

It is therefore desirable that containers for slurried explosives should be rigid as the cartridges have to withstand the pressure of being pushed, end to end, into boreholes of small diameter (that is, upto 50 mm) and remain in intimate contact thereafter for reliable performance of the explosives. Waterproofness is essential to prevent change in the properties of the explosives due to loss of water from inside and also from penetration of water from outside.

With this object in view, the waterproof and rigid container of the present invention has been made, which seeks to overcome all the disadvantages described above.

Accordingly, the present invention provides a waterproof and rigid container for slurried explosives which comprises a tube or shell formed by superimposing partially or wholly a shrinkable film on paper and rolling the film and paper into the shape of a tube or shell of continuous and successive layers of the film and paper, the inner layer being the film and the outer layer being the paper, and thereafter crimping the tube or shell at one end, the tube or shell so formed being externally coated with a suitable waterproofing medium under predetermined conditions thereby causing a partial shrinkage of the film and, when required, the waterproofed tube or shell is filled with an explosive and the filling or mouth end is crimped and waterproofed forming a rigid and waterproof cartridge.

The term "film" wherever used in the specification refers to a shrinkable polyolefin film.

Production of waterproof and rigid containers can be accomplished in many ways. By way of examples, the following method described:

a. Feeding a strip of shrinkable polyolefin film (such as low density polythene) from a roll, over a strip of paper, also fed from a roll, into a conventional shell making machine such as the Ayer Shell Machine so that the inner layer is the polyolefin film and the outer layer is the paper. The paper and polythene film are then cut to desired length, rolled into a tube and one end is folded and crimped in the usual manner and ejected from the machine. Shells thus formed have an inner layer of shrinkable polythene film with paper on the outside.

b. Waterproofing the shells externally, by dipping a batch of shells in a hot molten bath of suitable waterproofing medium, for example: paraffin wax containing a small percentage of rosin, the latter being added to improve the adhesion of wax, increase the shell rigidity when dry and also raise the melt temperature. However, the shells can even be waterproofed after the contents have been filled.

The temperature of the bath and the duration of dipping are required to be controlled to ensure that the heat imparted externally is adequate to shrink only the outermost layer of polythene film in the shell and the inner layer remains unaffected. It is also ensured that the open end is left unwaxed to facilitate closure after filling the contents.

As a result of waterproofing, the following characteristics are observed:

i. the outer paper surface of the shell is waterproofed, ii. the crimped end of the shell is sealed and rendered leakproof and (iii) adhesion is created between the outer layer of paper and polythene film to form a waterproof container.

c. Filling such shells through the open end by any of the conventional methods to ensure a uniform weight of contents and thereafter, folding and crimping this end, with suitable adjustment of the length of the fold to ensure that no void remains over the level of the contents in the shell, so that the explosive performs satisfactorily where such cartridges are pushed end to end into boreholes.

d. Sealing and rendering leakproof, the filling end either by a jet of hot air or by spraying thereon a hot, molten waterproofing medium which produces the functions enumerated under (b).

Alternatively, filling the shells after operation (a) and closing the end as described in (c) and thereafter externally, waterproofing such filled cartridges by dipping a batch of cartridges in a hot molten bath of a suitable waterproofing medium as described above under the above mentioned conditions.

The invention will now be described with reference to the accompanying drawings.

The shell is made from continuous and successive layers of polyolefin film (A) and paper (B) and the shell is externally coated with a waterproof coating (C).

Figure 3:
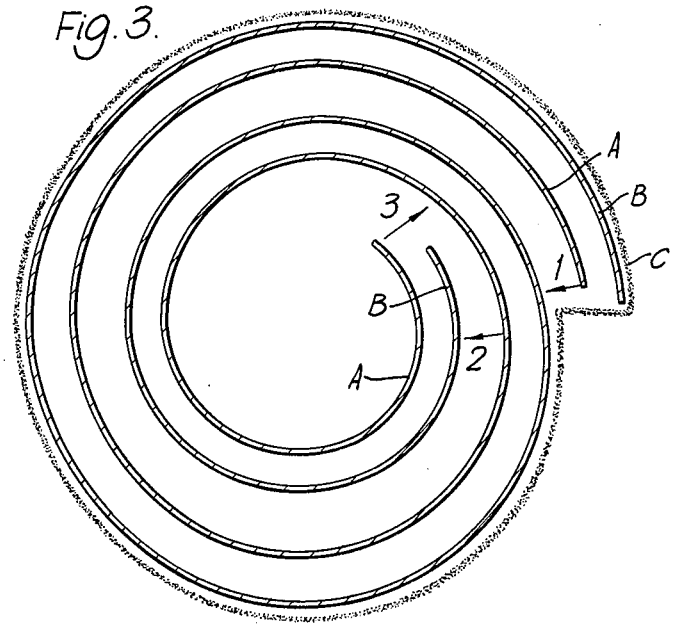
FIG. 3 is an exploded view of the cross-section of FIG. 1 taken along x — x.

As a result of such waterproofing which is carried out at a predetermined temperature in a bath containing a suitable waterproofing medium, the polyolefin A, which is shrinkable, shrinks inwards in the direction of the arrow, all around from the point marked 1 to the point marked 2 and is laminated to the paper B in the region 1 to 2, anticlockwise, in the FIG. 3.

At point 3 the polyolefin film A extends beyond the paper B and the lateral pressure of the contents ensures contact between the two layers of the polyolefin film A at this point, thereby sealing the contents from the paper B.

This results in the shell being rigid and at the same time waterproof.

Figure 1:
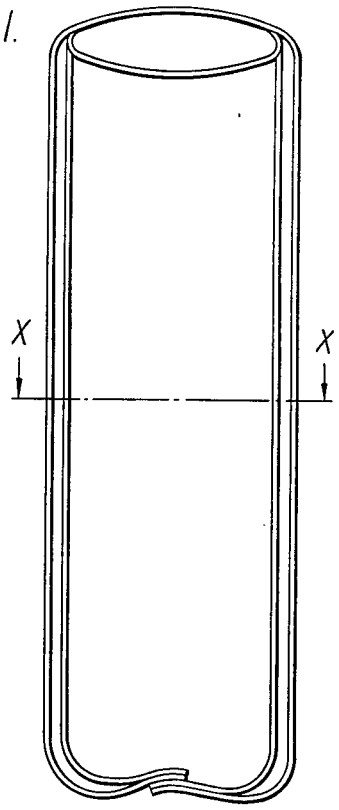
FIG. 1 is an empty shell crimped and sealed at one end.
Figure 2:
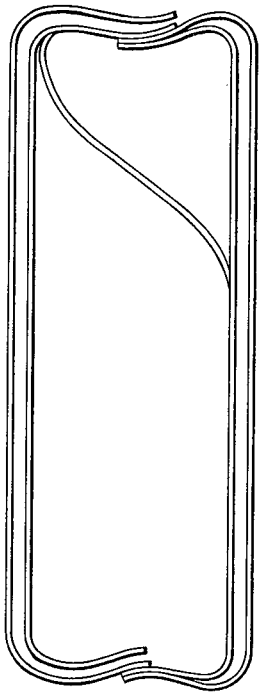
FIG. 2 is a shell filled, crimped and sealed at both ends.
Figure 4:
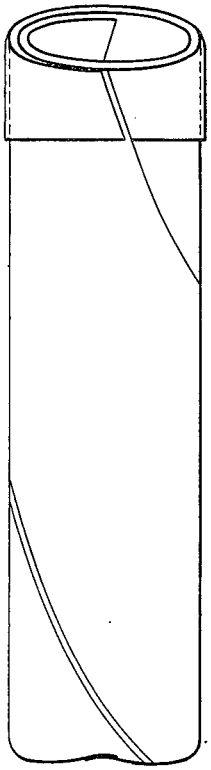
FIG. 4 is an empty shell crimped and sealed at one end with the film folded over at the other end.
Figure 5:
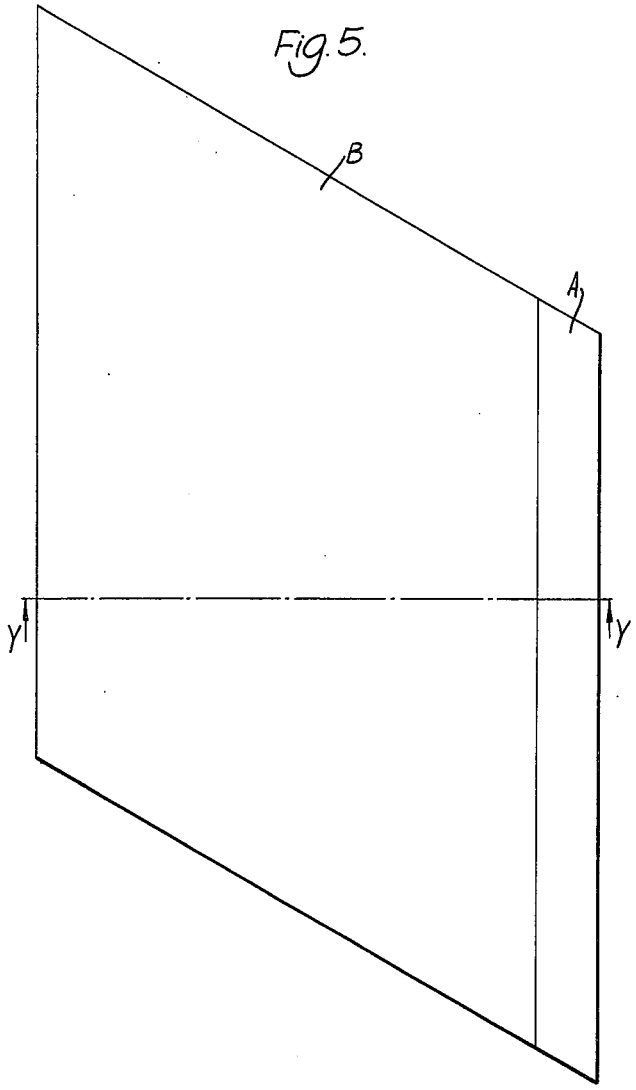
FIGS. 5 shows the alignment of a cut length of paper and the film folded over the said paper.
Figure 6:
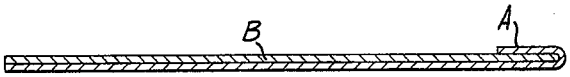
FIG. 6 is a cross section taken along the line y — y of FIG. 5.

A variation of the foregoing shell or tube illustrated in FIGS. 1 to 3 is depicted in FIG. 4, an empty shell crimped and sealed at one end and the shrinkable polyolefin film folded over the other end; and FIG. 5, showing the alignment of a cut length of paper and polyolefin film for such an arrangement. The shell, as described earlier, is made from continuous and successive layers of polyolefin film A and paper B, but in this embodiment the width of the film A being greater than the width of the paper B, and aligned such that the edges of the paper and the polyolefin film match on the side which is to be crimped on the shell making machine. The other edge of the film which projects beyond the edge of the paper is folded over the paper by means of suitable guides, prior to rolling into shells, the layers forming the configuration as shown in FIG. 6.

In the completed shell, FIG. 4, this arrangement reduces the possibility of fouling between the filling tube and the layers at the open end of the shell.

Figure 7:
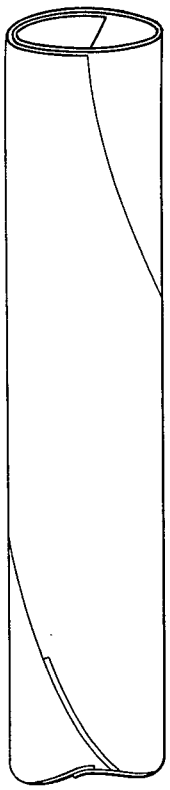
FIG. 7 shows an empty shell crimped and sealed at one end using a laminate of paper and polyolefin film with a strip of shrinkable film at the crimped end.
Figure 8:
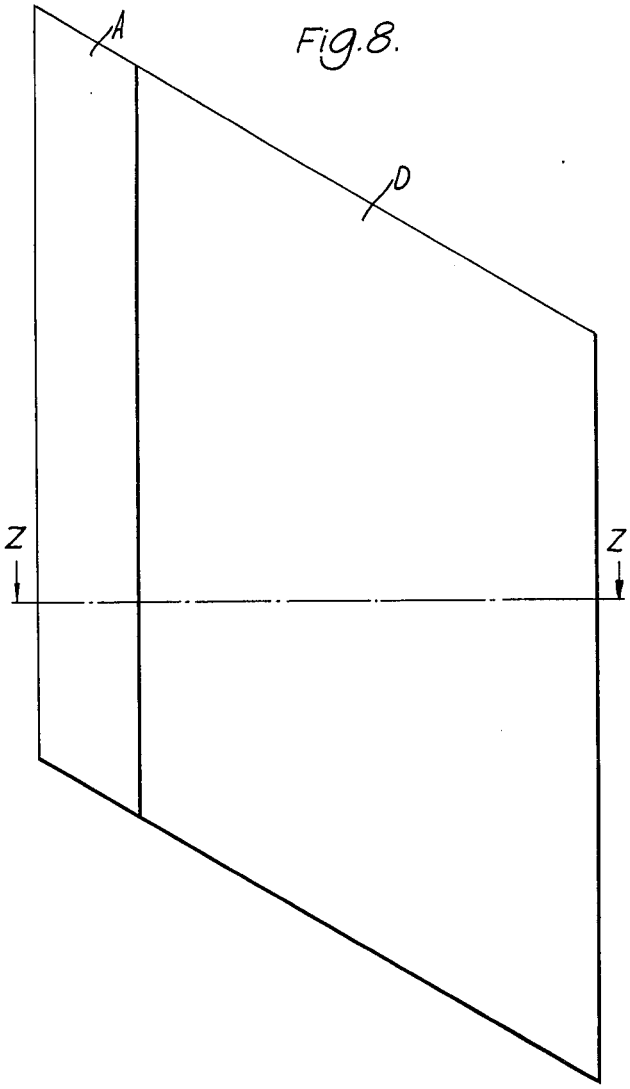
FIG. 8 shows the alignment of a cut length of paper-polyolefin laminate and the shrinkable film strip and FIG. 9 is a section taken along the line z — z of FIG. 8.
Figure 9:
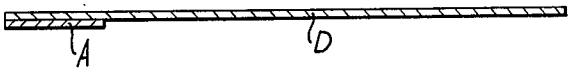

For use with slurried explosives having a lesser water content, a further variation shown in FIGS. 7 to 9 consists of the use of a laminate of paper and plastic or any other waterproofing film or foil or coating for the body of the shell with a thin strip of shrinkable film used at one end to provide an effective and a leakproof end closure. One such arrangement is shown in FIG. 7 — an empty shell, crimped and sealed at one end and FIG. 8 — showing the alignment of a cut length of the paper-polyolefin laminate D and the shrinkable film strip A along end edge only. For such an arrangement, the layers forming the configuration is shown in FIG. 9. The waterproofing of such shells, as described, results in rendering leak proof the crimped end of the shell. Further variations of this scheme consist of using such shrinkable polyolefin film strips, in combination with the paper/polyolefin laminate, at both ends of the shell and also having a fold-over arrangement of the strip used at the open end as described with reference to FIGS. 4 to 6.

These variations of the basic invention are mainly with a view of economise and provide at the same time a functional pack.

In all the foregoing embodiments the shells may be externally waterproofed first and then filled or vice versa, the latter being a more economical and convenient method for slurried explosives having a lesser water content.

The advantages of such a container are:

1. A rigid cartridge which can be easily loaded into boreholes.

2. A waterproof cartridge, preventing penetration of water from outside and also preventing changes in the properties of the content due to loss of water from the inside.

3. A cartridge which retains its shape and rigidity in spite of increase in the density of the contents, on storage, and consequent reduction in volume.

4. An economical pack with all the above advantages.

We claim:

1. A waterproof and rigid container for slurried explosives which comprises a tube or shell formed by superimposing partially or wholly a shrinkable film on paper and rolling the film and paper into the shape of a tube or shell of continuous and successive layers of the film and paper, the inner layer being the film and the outer layer being the paper, and thereafter crimping the tube or shell at one end, the tube or shell so formed being externally coated with a suitable waterproofing medium under predetermined conditions thereby causing a partial shrinkage of the film and, when required, the waterproofed tube or shell is filled with an explosive and the filling or mouth end is crimped and waterproofed forming a rigid and waterproof cartridge.

2. A container as claimed in claim 1 wherein the film and paper are of the same dimensions.

3. A container as claimed in claim 1 wherein the width of the film is greater than the width of the paper.

4. A container as claimed in claim 3 wherein the width of the film is greater at the mouth end of the tube or shell, the film extending beyond the paper is folded over the latter.

5. A container as claimed in claim 1 wherein the paper is laminated.

6. A container as claimed in claim 5 wherein a thin strip of film is used along the length of the paper at the closed end and/or the mouth end of the tube or shell.

7. A container as claimed in claim 6 wherein the film is greater at the mouth end of the tube or shell, the film extending beyond the paper is folded over the latter.

8. A container as claimed in claim 1 wherein the waterproofing medium consists of wax and rosin.

* * * * *